US006668973B2

(12) United States Patent
Grandmougin et al.

(10) Patent No.: US 6,668,973 B2
(45) Date of Patent: Dec. 30, 2003

(54) TRANSVERSE PARTITION FOR EXHAUST VOLUME

(75) Inventors: Michel François Roland Grandmougin, Seloncourt (FR); Jean-Luc Scanavin, Taillecourt (FR)

(73) Assignee: Faurecia Systemes d'Echappement, Boulogne (FR)

( * ) Notice: Subject to any disclaimer, the term of this patent is extended or adjusted under 35 U.S.C. 154(b) by 0 days.

(21) Appl. No.: 10/070,730

(22) PCT Filed: Jul. 25, 2001

(86) PCT No.: PCT/FR01/02436

§ 371 (c)(1),
(2), (4) Date: Mar. 12, 2002

(87) PCT Pub. No.: WO02/10561

PCT Pub. Date: Feb. 7, 2002

(65) Prior Publication Data

US 2002/0148679 A1 Oct. 17, 2002

(30) Foreign Application Priority Data

Jul. 31, 2000 (FR) ..... 0010081

(51) Int. Cl.[7] ..... F01N 1/08
(52) U.S. Cl. ..... 181/272; 181/264
(58) Field of Search ..... 181/272, 264, 181/268, 269, 270, 273, 275, 276

(56) References Cited

U.S. PATENT DOCUMENTS 4,177,875 A * 12/1979 Kurobe et al. ..... 181/265
4,580,656 A * 4/1986 Fukuda ..... 181/252

FOREIGN PATENT DOCUMENTS

JP 08189329 A * 7/1996 ..... F01N/1/08

* cited by examiner

*Primary Examiner*—Robert E. Nappi
*Assistant Examiner*—Renata D McCloud
(74) *Attorney, Agent, or Firm*—Sughrue Mion, PLLC

(57) ABSTRACT

The transverse partition for separating an exhaust volume into two adjacent chambers includes at least one gas flow passage between the two chambers, the gas flow section through the passage being modifiable under drive from the difference between the pressures on the two sides of the partition. The partition comprises a wall pierced by at least one slit defined between two adjacent edges of the wall, which wall is elastically deformable under drive from the difference between the pressures on the two sides of the partition, between a rest position in which wall continuity is ensured, the two edges of the slit being substantially touching, and a deformed position in which the two edges of the slit are spaced apart so as to define said gas-flow passage between them.

13 Claims, 3 Drawing Sheets

TRANSVERSE PARTITION FOR EXHAUST VOLUME

The present invention relates to a transverse partition for separating an exhaust volume into two adjacent chambers, the partition being of the type comprising at least one passage for allowing gas to flow between the two chambers, the gas flow section through the passage being modifiable under drive from the difference between the pressures on the two sides of the partition.

BACKGROUND OF THE INVENTION

In exhaust mufflers, it is known to define two adjacent chambers that are separated by a transverse partition, the chambers being capable of being put into communication with each other automatically at high engine revolutions.

For this purpose, a flap valve is installed on the transverse partition extending across the exhaust muffler and separating the two adjacent chambers.

By way of example, such a valve is described in Japanese patent application JP-08004990. That valve comprises a seat defining a gas flow passage and a flap hinged to an edge of the seat. The flap can be moved between a closed position where it bears against the seat and a position in which it is spaced apart from the seat allowing gas to flow freely. A spring is provided to urge the flap towards its closed position. The flap is moved away from the seat under drive from the difference between the pressures in the two chambers.

The valve structure described in that document is very complex and it incorporates a large number of parts, thereby considerably increasing the cost of manufacturing an exhaust muffler that incorporates it.

OBJECTS AND SUMMARY OF THE INVENTION

An object of the invention is to propose a transverse partition for an exhaust volume that allows gas to pass through in controlled manner and that can be manufactured at very low cost, and also to propose an exhaust muffler incorporating it.

To this end, the invention provides a transverse partition of the above-specified type for separating an exhaust volume into two adjacent chambers, the partition comprising a wall pierced by at least one slit defined between two adjacent edges of the wall, which wall is elastically deformable under drive from the pressure difference between the two sides of the partition, between a rest position in which wall continuity is ensured, the two edges of the slit being substantially touching, and a deformed position in which the two edges of the slit are spaced apart so as to define said gas flow passage between them.

In particular embodiments, the partition includes one or more of the following characteristics:

said wall is generally plane;

said slit is generally spiral-shaped;

said wall is generally cylindrical;

said slit is generally helically shaped;

said generally cylindrical wall is closed at one of its ends;

the partition comprises a generally plane main panel, and said generally cylindrical wall extends perpendicularly to said panel;

one of the surfaces of the generally cylindrical wall is covered by a gas-permeable sheath, in particular a braid;

said slit is wound around at least two turns;

the thickness of the region of the wall in which the slit is defined is greater than the average thickness of said partition; and the thickness of the wall region where the slit is defined is greater than the average thickness of said partition.

The invention also provides an exhaust muffler defining an enclosure and including at least one transverse partition as defined above, said partition defining two adjacent chambers within the enclosure.

BRIEF DESCRIPTION OF THE DRAWINGS

The invention will be better understood on reading the following description given purely by way of example and made with reference to the drawings, in which.

MORE DETAILED DESCRIPTION

Figure 1:
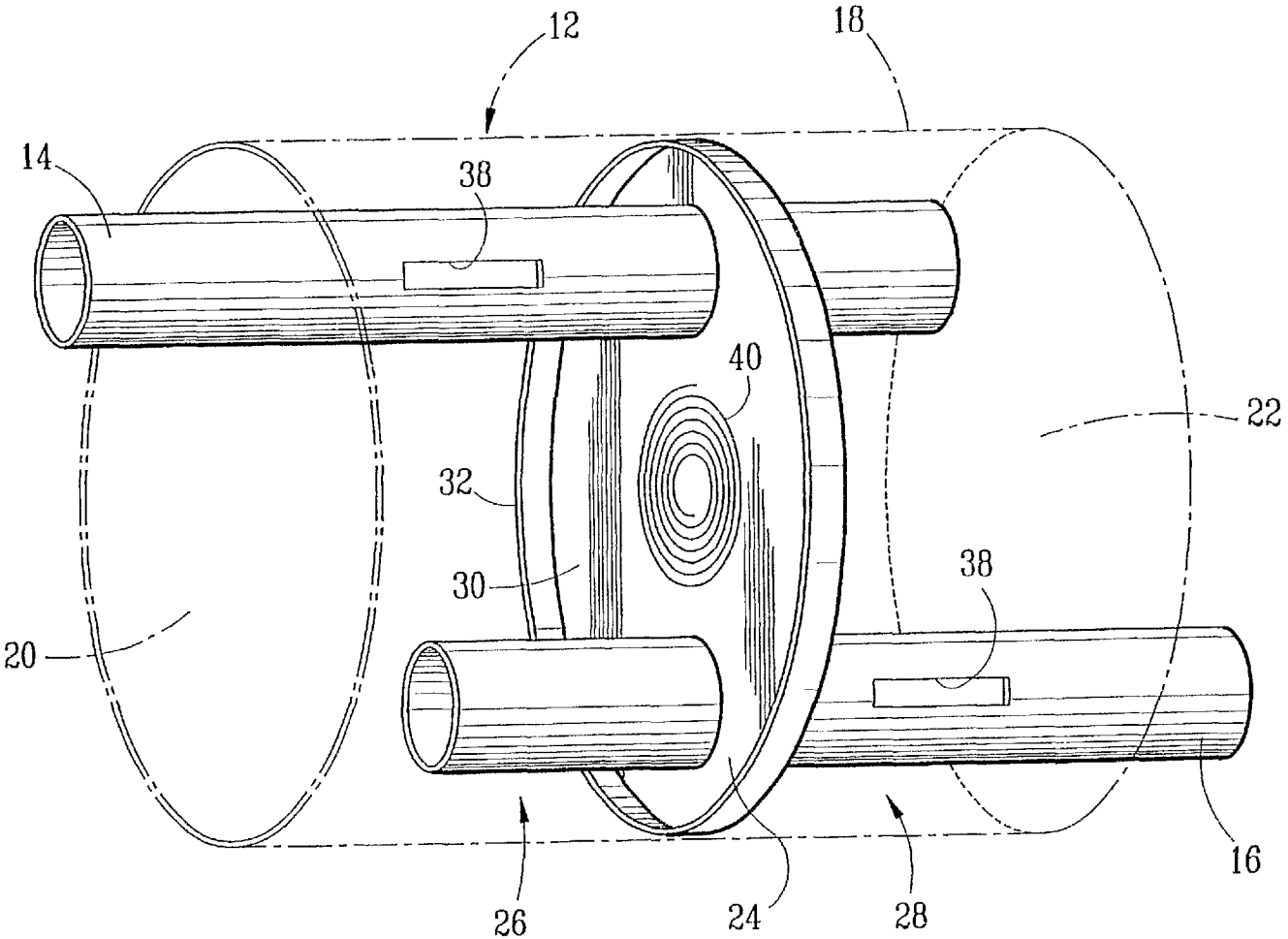
FIG. 1 is a perspective view of an exhaust muffler of the invention.

The exhaust muffler shown in FIG. 1 comprises an exhaust volume 12, a gas feed tube 14, and a gas exhaust tube 16. The volume 12 comprises a generally cylindrical case 18 closed at each end by an end wall 20, 22. The tubes 14 and 16 pass through the end walls 20 and 22 and project into the inside of the exhaust volume.

The volume 12 also has an intermediate partition 24 extending transversely and defining two adjacent chambers 26 and 28 inside the volume 12.

Such a transverse partition can also be referred to as a "cup".

Figure 2:
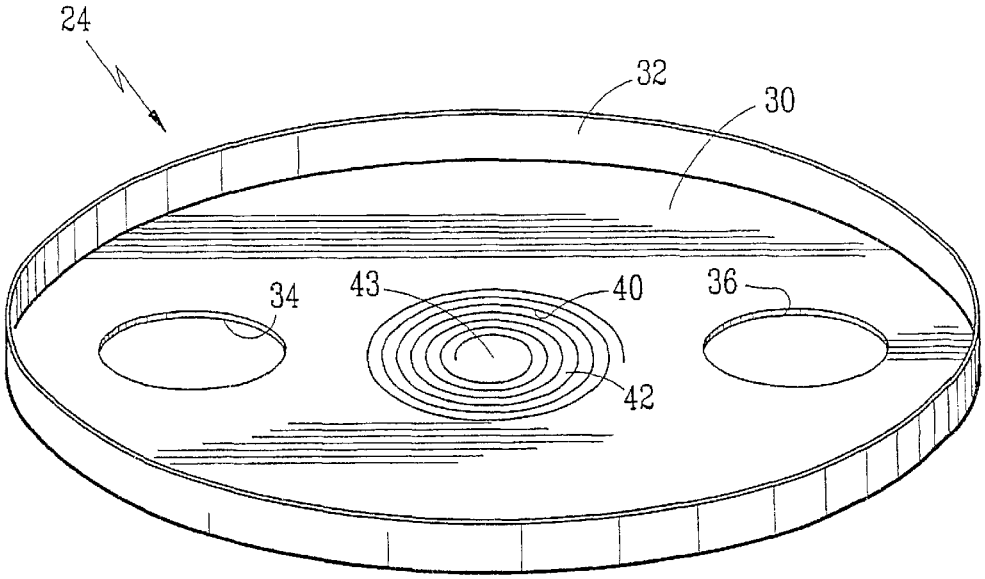
FIG. 2 is a perspective view of the intermediate partition of the FIG. 1 muffler, the partition being shown at rest.

FIG. 2 shows the partition 24 at rest. It comprises a plane main wall 30 in the form of a disk surrounded by a peripheral rim 32 enabling the intermediate partition 24 to be secured to the casing 18 of the exhaust volume.

The main wall 30 is pierced by two openings 34, 36 each serving to pass one of the tubes 14 and 16. Thus, each tube passes through the intermediate partition 24 and opens out into a chamber of the exhaust volume after passing right through the adjacent chamber.

The running portions of the tubes 14 and 16 are provided with side slots 38 that open out into the chambers which they pass right through.

In its central region, the main wall 30 is pierced by at least one slit 40 made in an elastically deformable region of the wall.

The region where the slit 40 is formed can be of thickness that is different from the average thickness of the wall 30, which in this example means the major portion of the partition. Advantageously, the thickness of the region where the slit is formed is greater than the average thickness of the wall. The values of these thicknesses can lie in the range 0.4 millimeters (mm) to 2 mm. For example, the wall 30 can be made of steel. The thickness of the wall in the region where the slit is formed can be 1 mm while its thickness outside the region in which the slit is formed can be 0.5 mm.

In an embodiment that is not shown, the region where the slit 40 is formed can be constituted by an extra part. This part is secured to the wall 30 by any means of appropriate type, e.g. rivets.

In the embodiment shown in FIG. 2, the slit 40 is generally spiral shaped. It is wound over about five turns. The slit is wound advantageously over more than one turn. The slit 40 thus defines a spiral-shaped strip 42 in the central portion of the wall 30 and extended in its central portion by a disk 43 formed integrally therewith.

Advantageously, the slit 40 is made by laser cutting. It could also be formed by punching.

The slit 40 is of small width, such that the two edges defining the slit lie in the immediate vicinity of each other when the partition 24 is at rest, i.e. when it is not being stressed by a difference in pressure between its two faces. Under such conditions, the spiral shape 42 lies in the main plane of the wall 30 thus forming a substantially solid screen presenting very little leakage between the two chambers of the exhaust volume, with the edges of the slit 40 then being substantially adjacent.

Figure 3:
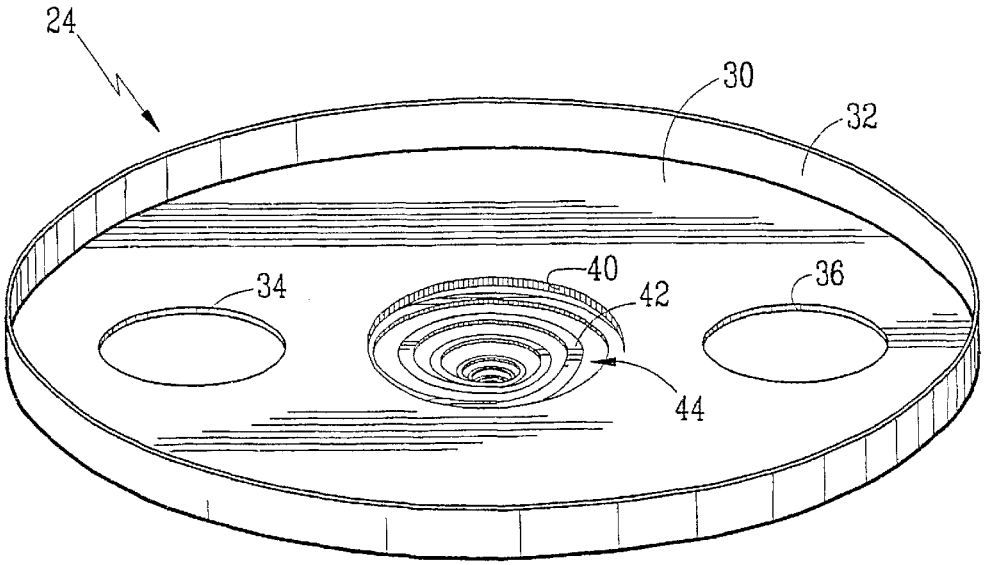
FIG. 3 is a view analogous to FIG. 1 showing the same intermediate partition, the partition being shown elastically deformed under drive from a pressure difference between its two faces.

In contrast, when a significant pressure difference exists between the chambers 26 and 28, the spiral strip 42 is stretched by elastic deformation as shown in FIG. 3. The strip deforms in a direction that is substantially perpendicular to the plane of the wall 30. The edges defining the slit 40 are then spaced apart leaving between them a passage 44 that allows gas to flow from one chamber to the other.

Once the pressures in the two chambers 26 and 28 have come into equilibrium, the elastically deformed region of the wall returns to its position shown in FIG. 2 under drive from the elasticity of the spiral shape 42. In this position, continuity of the solid wall 20 is provided.

In another variant, resilient means are associated with the spiral strip 42 so as to assist it returning to its initial position once pressure has moved into equilibrium. Advantageously, the resilient means are constituted by a spring having one end secured to the disk 43 and a second end secured to the end wall 22. The person skilled in the art can define suitable characteristics for the spring, and in particular its stiffness. In this embodiment, the spring is sheltered from the high temperature gas flow and serves to guarantee increased lifetime for the device of the invention.

It will be understood that using a deformable region defined by a slit through the wall 30 makes it possible to ensure that gas flows in controlled manner between the two chambers, with such flow being possible only if a sufficient pressure difference exists between the two chambers. In addition, this gas flow control can be obtained at a manufacturing cost that is very low since there is no need to add any particular elements into the exhaust volume.

Figure 4:
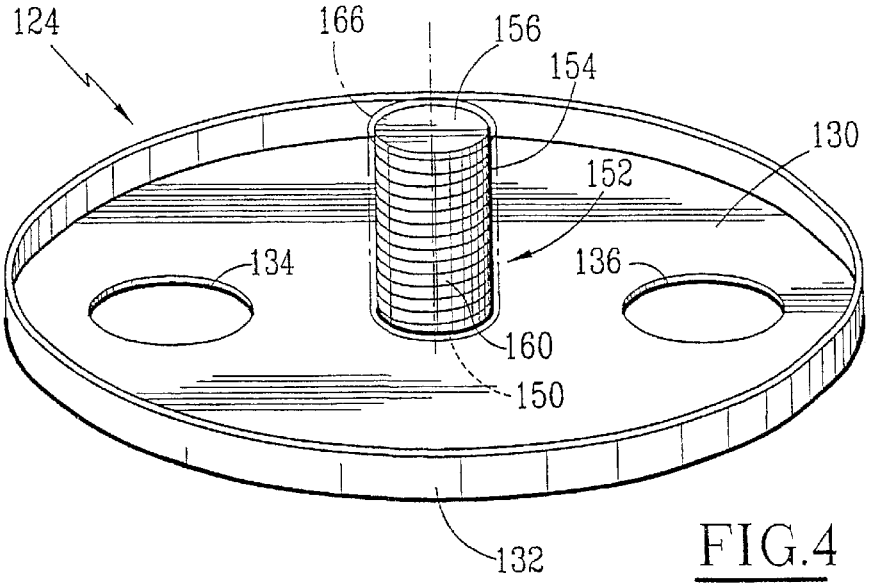
FIG. 4 is a perspective view of a variant embodiment of the intermediate partition, the partition being shown at rest.
Figure 5:
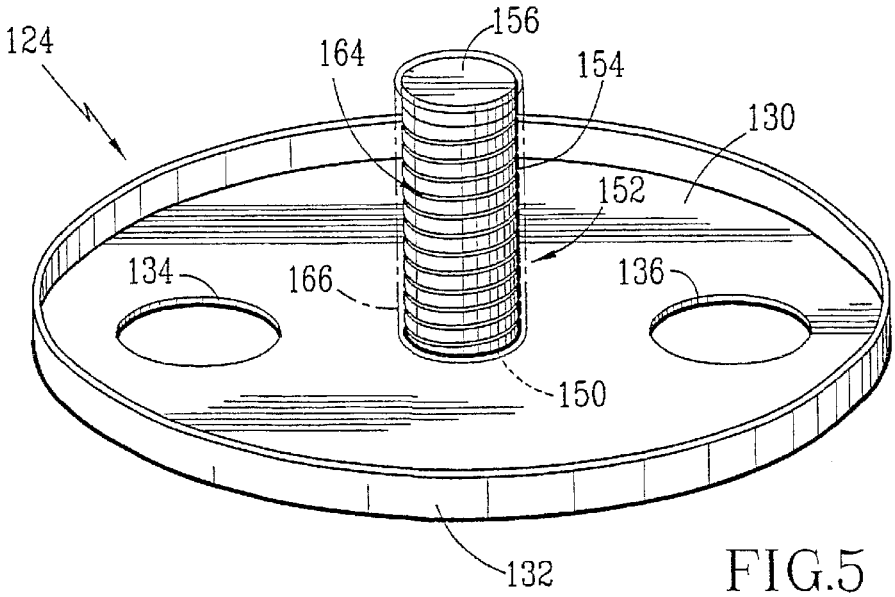
FIG. 5 is a perspective view of the FIG. 4 partition shown deformed under drive from a pressure difference between its two faces.

FIGS. 4 and 5 show another embodiment of a transverse partition 124 that can be implemented in the exhaust muffler of FIG. 1 by replacing the intermediate partition 24. In this embodiment, elements which are identical or analogous to those of the embodiment shown in FIGS. 2 and 3 are given the same reference numerals plus 100.

Thus, the transverse partition 124 has a main panel 130 in the form of a disk with a surrounding rim 132 and it is provided with two openings 134 and 136 for passing tubes 14 and 16. In its central portion, the panel 130 has a third opening of circular section 150 with a tube 152 fitted to the perimeter thereof, which tube is defined by a cylindrical wall 154. The tube 152 is of circular section. In a variant, its circular section could be of varying radius or its section could be elliptical. It presents an axis X—X extending perpendicularly to the panel 130. The tube is made of an elastically deformable material, e.g. a steel of the Inconel (registered trademark) type or a stainless steel having a thickness of 0.8 mm. In contrast, the thickness of the main panel 130 is 0.5 mm.

The tube 152 is crimped at one end to the surface of the panel 130. Thus, it extends on one side only of the panel 130. At its free end, the tube 152 is closed by a stopper 156 which is constituted in this case by a disk welded thereto.

Over the major part of its length, the cylindrical wall 154 presents a slit 160. This slit is helically shaped. It extends over some number of turns that is greater than two, and which is equal to twelve, for example. The slit thus defines turns 162 along the tube.

At rest, as shown in FIG. 4, the edges defining the slit 160 are touching so that the wall 154 defines a continuous surface forming an essentially gastight barrier between the two chambers of the exhaust muffler. The turns 162 then touch one another.

In contrast, when the pressure in the chamber communicating with the inside of the tube 152 increases, then the wall 154 expands under elastic deformation and the initially touching edges of the slit 160 move apart from one another so as to define a gas flow passage 164 which is helical in shape. The turns 162 are then no longer touching.

After pressure has returned to equilibrium in the two chambers, the cylindrical wall 154 returns to its initial shape under drive from the elasticity of the wall 154. The turns 162 defined by the slit 160 are then touching.

In a variant, a gas-permeable sheath 166 is fitted over the major fraction of the surface of the tube 152 in contact with one and/or the other of the surfaces of the cylindrical wall 152. In an additional variant (not shown), the sheath 166 is fitted to the surface of the turns 162. By way of example, the sheath can be made of a metal braid or a composite material braid. Such a sheath is represented by chain-dotted lines in FIGS. 4 and 5.

The presence of this sheath reduces the noise that results from gas flowing in the tube.

In an additional variant, resilient means are associated with the tube 152 for assisting it back into its initial shape after pressures have returned to equilibrium. Advantageously, the resilient means are constituted by a spring secured via a first end to the stopper 156 and via its second end to the end wall 22. The person skilled in the art knows how to define suitable characteristics for the spring, and in particular its stiffness. In this embodiment, the spring which is sheltered from any high temperature gas flow serves to provide longer lifetime for the device of the invention.

What is claimed is:

1. A transverse partition for separating an exhaust volume into two adjacent chambers, the partition being of the type comprising at least one passage for allowing gas to flow between the two chambers, the gas flow section through the passage being modifiable under drive from the difference between the pressures on the two sides of the partition, the partition comprising a wall pierced by at least one slit defined between two adjacent edges of the wall, which wall is elastically deformable under drive from the pressure difference between the two sides of the partition, between a rest position in which wall continuity is ensured, the two edges of the slit being substantially touching, and a deformed position in which the two edges of the slit are spaced apart so as to define said gas flow passage between them, wherein the thickness of the region of the wall in which the slit is defined is greater than the average thickness of said partition.

2. A partition according to claim 1, wherein said wall is generally plane.

3. A partition according to claim 2, wherein said slit is generally spiral-shaped.

4. A partition according to claim 3, wherein said slit is wound around at least two turns.

5. A partition according to claim 1, wherein said wall is generally cylindrical.

6. A partition according to claim 5, wherein said slit is generally helically shaped.

7. A partition according to claim 5, wherein said generally cylindrical wall is closed at one of its ends.

8. A partition according to claim 5, comprising a generally plane main panel, and wherein said generally cylindrical wall extends perpendicularly to said panel.

9. A partition according to claim 5, wherein one of the surfaces of the generally cylindrical wall is covered by a gas-permeable sheath, in particular a braid.

10. An exhaust volume defining an enclosure and including at least one partition in accordance with claim 1, which partition defines two adjacent chambers within the enclosure.

11. The partition according to claim 1, wherein said region in which said slit is defined is smaller than a major portion of said wall.

12. The partition according to claim 11, wherein said thickness of said region and said average thickness lie in the range of 0.4 mm to 2 mm.

13. The partition according to claim 12, wherein the thickness of said wall in said region is 1 mm. and wherein said major portion has a thickness of 0.5 mm.

* * * * *